US008347430B2

(12) United States Patent
Malouf et al.

(10) Patent No.: US 8,347,430 B2
(45) Date of Patent: Jan. 8, 2013

(54) MATTRESS PROTECTOR

(76) Inventors: Sam Malouf, Millville, UT (US); Kacie Malouf, Millville, UT (US); Nat Holfeltz, Millville, UT (US)

( * ) Notice: Subject to any disclaimer, the term of this patent is extended or adjusted under 35 U.S.C. 154(b) by 0 days.

(21) Appl. No.: 13/338,705

(22) Filed: Dec. 28, 2011

(65) Prior Publication Data

US 2012/0167302 A1 Jul. 5, 2012

Related U.S. Application Data

(60) Provisional application No. 61/428,068, filed on Dec. 29, 2010.

(51) Int. Cl.
*A47C 31/00* (2006.01)

(52) U.S. Cl. ..... 5/484; 5/497; 5/501

(58) Field of Classification Search ..... 5/482, 484, 5/496–501, 486
See application file for complete search history.

(56) References Cited

U.S. PATENT DOCUMENTS 5,050,256 A * 9/1991 Woodcock ..... 5/699
5,966,759 A * 10/1999 Sanders et al. ..... 5/499
7,552,489 B2 * 6/2009 Bell et al. ..... 5/499

* cited by examiner

*Primary Examiner* — Fredrick Conley
(74) *Attorney, Agent, or Firm* — Peck Hadfield Baxter & Moore, LLC; Preston P. Frischknecht

(57) ABSTRACT

A mattress protector having a top portion and a bottom portion configured to fasten together over the mattress and/or a mattress and box spring includes sides and ends extending from each of the top portion and the bottom portion. A fastener is also included on each of the top and bottom portions. The fastener includes a fastener assembly to seal the mattress against bed bugs and dust mites. When the top and bottom portions are placed around the mattress, and the fastener is secured, the entire mattress is surrounded by the mattress protector and protected from penetration by bed bugs and dust mites.

14 Claims, 5 Drawing Sheets

FIG. 1

MATTRESS PROTECTOR

CLAIM OF PRIORITY

This application claims priority to U.S. Provisional Patent Application No. 61/428,068, entitled "Mattress Protector", filed Dec. 29,2010, which application is incorporated herein by reference.

BACKGROUND OF THE INVENTION

1. The Field of the Invention

The present invention relates generally to textiles. More specifically, embodiments of the present invention relate to mattress protecting textiles.

2. Related Art

Use of mattress protectors under bedding is ubiquitous and common practice in residential settings, as well as in commercial settings, such as hotels and the like. Mattress protectors are part of a larger group of textiles that ranges from plastic and vinyl mattress coverings to simple cloth mattress coverings to shaped and contoured thick mattress pads. Such products are used to increase the comfort of mattresses, to protect the mattress from wear, and to prolong the useful life of the mattress.

Typically, mattress coverings designed specifically to protect mattresses have been developed for protecting mattresses from fluids. These products include mattress protectors made of plastic or vinyl or other liquid-impermeable materials. Other mattress protector products that are designed to protect mattresses from fluids have been developed of breathable fabrics and materials that allow for airflow through the protector barrier, while at the same time preventing the leaking of fluids through the mattress protector onto the mattress.

In recent years, mattress protector products have become even more sophisticated in their design and construction in order to combat not only problems caused by fluid being released onto a mattress, but also to protect mattresses from other harms, most notably bed bugs and dust mites. However, design of comfortable and functional mattress protectors that can completely eliminate bed bugs and dust mites has been elusive.

What is needed is a functional mattress protector that is easy to put on and remove from the mattress that can eliminate bed bugs and dust mites, as well as protect the mattress from fluids.

BRIEF SUMMARY OF THE INVENTION

Embodiments of the present invention include a mattress protector that substantially surrounds a mattress, or a mattress and box spring, and that protects the mattress from fluid and from bed bugs and dust mites. The mattress protector is configured from fluid-impermeable, pest-impermeable material, and further includes reinforced closures for protecting against pest infiltration of the mattress. The closures are protected by a seal created by deformable material, and/or an enclosure surrounding ends of a fastener to thwart the passage of pests through the mattress protector.

BRIEF DESCRIPTION OF THE DRAWINGS

The foregoing and other advantages and features of the invention will become apparent upon reading the following detailed description and upon reference to the drawings, in which.

A

DESCRIPTION OF EXEMPLARY EMBODIMENTS OF THE INVENTION

Embodiments of the present invention include mattress protectors that substantially surround the entirety of a mattress, protect the mattress from damage from fluids, and also protect the user and mattress from dust mites, bed bugs, and other pests that may thrive in a mattress. A mattress protector includes two portions that are connected at a closed end. The mattress protector also includes a top, a bottom, and two sides (a first side and a second side), all extending from the closed end. The top, bottom, and two sides also meet at an open end. A zipper is configured to begin on the first side near the closed end, extending the length of the first side, through the open end, substantially the entire length of the second side, and ending near the closed end. The zipper closure is further configured to prevent bed bugs and other pests from passing through the mattress protector.

Figure 1:
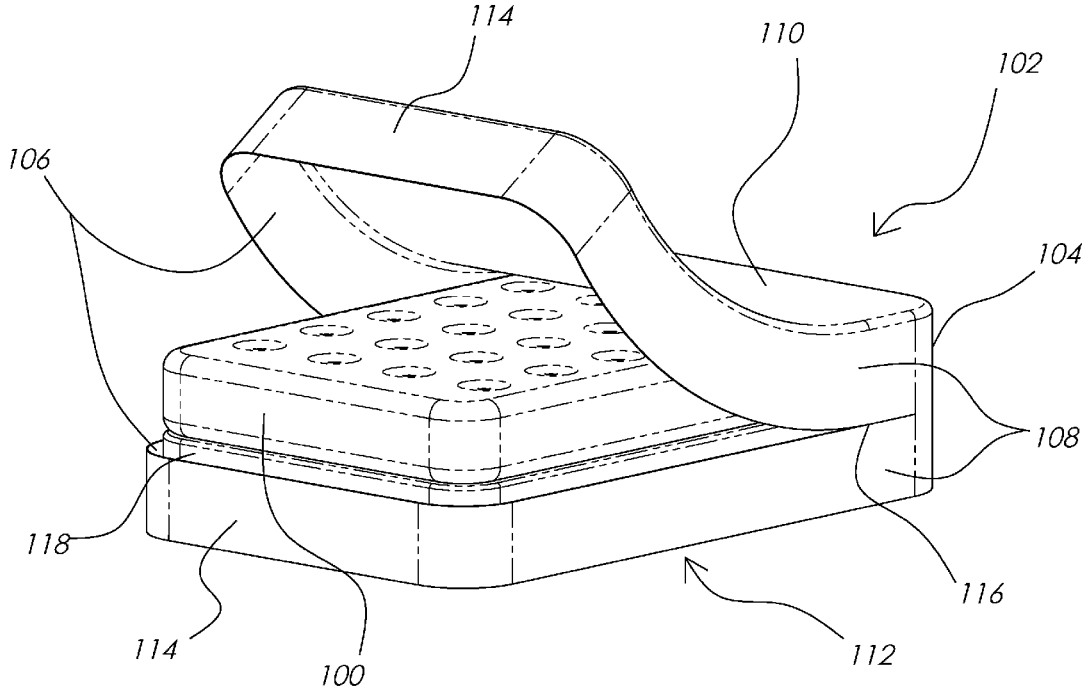
FIG. 1 shows an isometric view of a mattress and box spring surrounded by a mattress protector.

With attention now to FIG. 1, a mattress 100 and one embodiment of a mattress protector 102 are shown. Mattress protector 102 has a first end 104, also referred to as a closed end, or an end that does not open or come apart. Two sides, a first side 106 and a second side 108, a top 110, and a bottom 112 are connected to and extend from the closed end 104. Although the bottom is not explicitly shown in FIG. 1, reference numeral 112 shows generally where the bottom 112 of the mattress protector is located and provides a reference for the location of bottom 112 in relation to the other portions of the mattress protector 102.

As noted above, the two sides 106 and 108, the top 110, and the bottom 112 are connected to the closed end 104. Each of the two sides 106 and 108, the top 110, and the bottom 112 extend from the closed end 104 to a second end 114. Second end 114, as well as sides 106 and 108, is essentially formed of two detachable pieces joined together by a fastener (not shown). In one embodiment of the invention the fastener is a zipper. An example of the attachment of two of the detachable pieces to form part of the mattress protector 102 is shown in FIG. 1 at line 116, where two detachable portions of side 108 are joined. The detachable feature of the sides 106 and 108 and second end 114 of the mattress protector 102 create a mattress protector 102 with essentially two configurations—an open configuration and a closed configuration. FIG. 1 shows an example of an open configuration.

In operation, mattress protector 102 protects a mattress by substantially surrounding the entire mattress. In one embodiment of the invention, the mattress protector 102 substantially surrounds a box spring 118 as well as a mattress 100. In order to secure the mattress protector 102 over a mattress 100 and box spring 118, the mattress protector 102 is placed in the open position—the configuration in which the detachable portions of sides 106 and 108, and second end 114, are detached. Stated differently, in order to fit the mattress protector 102 around the mattress 100 and box spring 118, the fastener joining detachable portions of sides 106 and 108, and second end 114, must be unfastened.

With the mattress protector 102 unfastened, closed end 104 is placed around an end of the mattress 100 and box spring 118. The mattress 100 and box spring 118 are then lifted up and the bottom 112 is pulled under the box spring. Similarly, top 110 is pulled over the mattress. Corresponding portions of sides 106 and 108 are pulled up from the bottom 112 and down from the top 110. Likewise, corresponding portions of second end 114 are pulled up from the bottom 112 and down from the top 110 of the mattress protector 102. Once the closed end 104, top 110, bottom 112, sides 106 and 108, and second end 114 are placed around the mattress, the fastener that joins the detachable sides of sides 106 and 108, and second end 114, is fastened. Once the fastener is secured, the mattress protector 102 is in a closed position surrounding the mattress 100 and box spring 118.

The mattress protector 102 is fabricated from materials that are liquid impermeable, thus creating a mattress protector 102 that prevent liquids from contacting the mattress 100. Moreover, the mattress protector is further configured to be impervious to bed bugs, dust mites, and other pests. In order to achieve this result, the mattress protector is configured of materials impervious to these pests. The above properties may be accomplished using a number of materials, including polyester, cotton, and polyester cotton blends, in combination with polyurethane laminates. Fu, seams and other areas that are typically vulnerable to penetration by pests, are reinforced and configured to prevent pests from passing through.

Figure 3A:
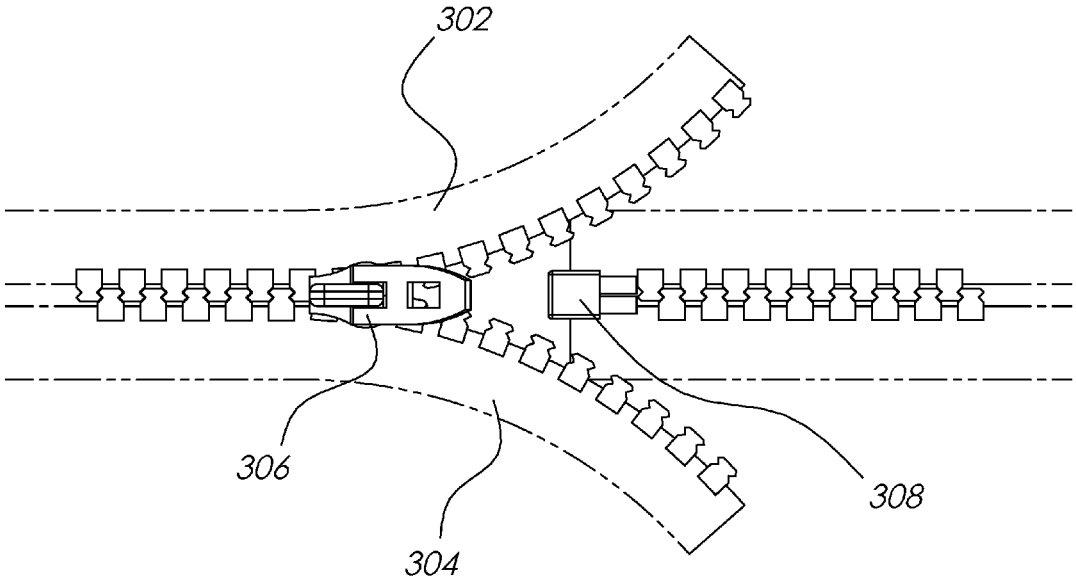
FIG. 3A shows a top view of a zipper junction.
Figure 3B:
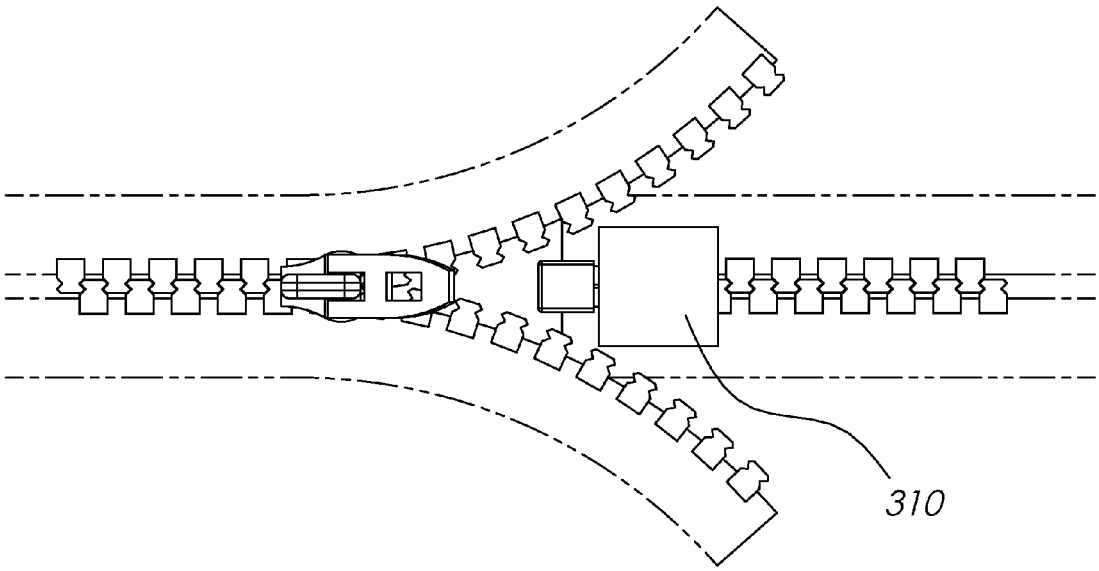
FIG. 3B shows a top view of a zipper junction including a zipper end barrier.
Figure 4:
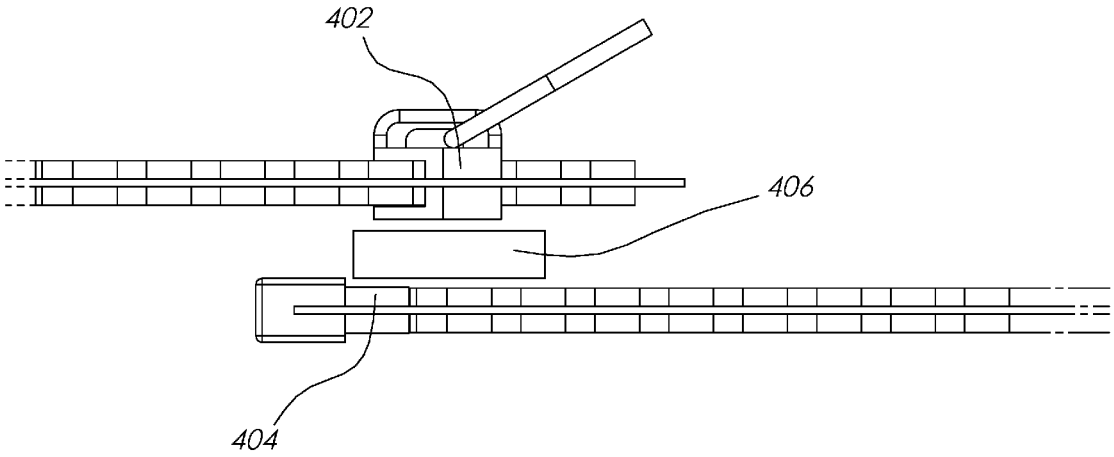
FIG. 4 shows a side view of a zipper end barrier.

In particular, the end portion of the fastener, typically the most vulnerable location for pest permeation of the mattress protector, is configured to prevent pest passage. Referring briefly to FIGS. 3A and 3B, in one embodiment of the invention where the fastener is a zipper, a first side of the fastener 302 is connected to a bottom edge of the top portion and a second side of the fastener 304 is connected to a top edge of the bottom portion. Referring briefly now to FIG. 4, the first and second sides of the fastener are configured to releasably interlock and form first 402 and second 404 ends of the fastener when releasably interlocked. The second or beginning end of the zipper is sewn into the fabric under a piece of deformable material that presses down on the zipper end and seals the starting point of the zipper. The first or terminating end of the zipper, the end having the termination of the zipper pull, may be configured under at least one additional layer of pest impermeable fabric that has been configured as a pocket in which the zipper head is housed. Bed bugs and other pests are incapable of passing through the fabric of the mattress protector 100, the deformable material reinforcing the zipper end, and the pocket configuration of the zipper head location. The zipper end and zipper head barriers are described in additional detail with reference to FIGS. 3A and 3B below.

Figure 2:
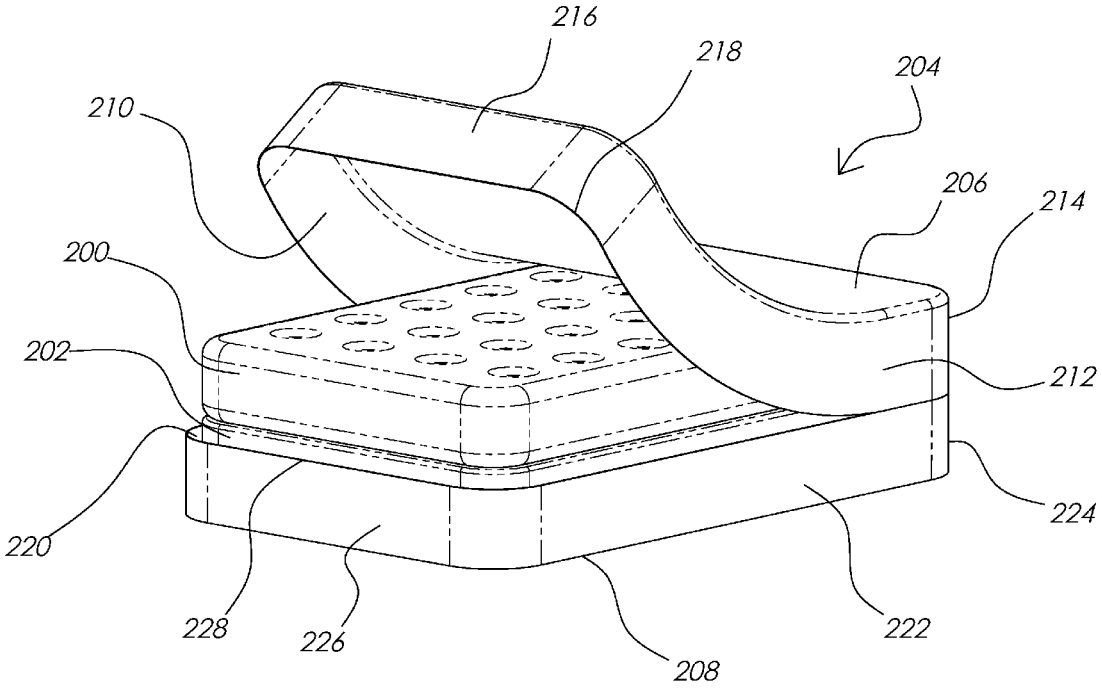
FIG. 2 also shows an isometric view of a mattress and box spring surrounded by a mattress protector.

FIG. 2 shows a mattress 200 with box spring 202 and different embodiment of the mattress protector 204 than that shown in FIG. 1. Mattress protector 204 has a top 206 and a bottom 208. Top 206 is attached to two sides and two ends, referred to in FIG. 2 as top left side 210, top right side 212, top first end 214, and top second end 216. Although top first end 214 is not shown explicitly in FIG. 2, the location of top first end 214 can be appreciated by reference to the drawing and by virtue of the position of top first end 214 between top left side 210 and top right side 212 and attached to top 206. A fastener 218, such as, for example, a zipper, is also attached to the bottom edge of top left side 210, top right side 212, top first end 214, and top second end 216.

Like top 206, bottom 208 is attached to two sides and two ends, referred to in FIG. 2 as bottom left side 220, bottom right side 222, bottom first end 224, and bottom second end 226. In one embodiment of the invention, elastic material is placed in the bottom 208 near the sides 220 and 222, and ends 224 and 226, to help the mattress protector 204 fit snugly over the mattress 200, or the mattress 200 and box spring 204. Each of the sides and ends is also attached to a fastener 228. Fastener 228 is further configured to join with fastener 218 so that the entire top portion of the mattress protector can be joined with the bottom portion of the mattress protector, thus surrounding the mattress protector.

In operation, bottom 208 is placed beneath the box spring 202, or in an instance where there is no box spring in use with the mattress, bottom 208 is placed directly beneath the mattress 200. With bottom 208 beneath the mattress 200 or box spring 202, each of the bottom left side 220, the bottom right side 222, the bottom first end 224, and the bottom second end 226 is brought around the sides and bottom of the box spring 202 or mattress 200.

Similarly, top 206 is placed on top of the mattress 200 and top left side 210, top right side 212, top first end 214, and top second end 216 are brought around the sides and ends of the mattress 200. With the top and bottom portions of the mattress protector 200 positioned in this way, the fasteners 218 and 228 are located near each other and can be fastened together. For example, in one embodiment of the invention where fasteners 218 and 228 are two sides of a zipper, the zipper ends are engage and the zipper is zipped around the left and rights sides, and first and second ends, of the mattress 200 and box spring 202, and then secured. In such a configuration the mattress protector 204 is secured around the mattress. In one embodiment of the invention, when the mattress protector 204 needs to be cleaned, top portion 206 can be removed from the mattress and cleaned without the need for bottom portion 208 to be removed.

To provide the best protection of the mattress 200, the mattress protector 204 is made of liquid impermeable material that also prevents bed bugs, dust mites, and other pests from passing through it. Moreover, the fastener of mattress 200 is configured to prevent pests from passing through to the mattress 200 as well. The configuration of the zipper ends is shown in greater detail with reference to FIGS. 3A, 3B, and 4 below.

In order to prevent dust mites and bed bugs from accessing the mattress 102, a seam located at line 116 and extending along the length of detachable portions is constructed to create a pest-impervious barrier by overlapping portions of pest impervious materials around the fastening mechanism, such as a zipper. In creating a pest-impervious fastening barrier, one area of potential vulnerability is the point at which the zipper or other fastener ends. Typically, such areas are vulnerable to pest penetration because the zipper or other fastener end cannot be sealed in the same way as the rest of the fastened seam. However, embodiments of the present invention provide a barrier at this junction that prevents pests from permeating the mattress protector 104 at the zipper's end.

With attention now to FIG. 3A, a top view of the zipper closure and pest-impermeable junction is shown, as discussed briefly above. Two portions 302 and 304 of the mattress protector are shown being joined as a zipper head 306 is closed. Because the top portion of the mattress protector 302 can be completely removed from the bottom portion of the mattress protector 304, the zipper joining the top and bottom portions has a length just greater than the circumference of the mattress protector and the mattress. Thus, when mattress portion 302 is joined with mattress portion 304, as shown in FIG. 3A, the zipper head 306 forms a first fastener end overlaps the tail portion or second fastener end of the zipper 308. The overlapping of the zipper end 306 and zipper beginning 308 in this manner helps to create a pest impermeable barrier at the zipper junction. The zipper junction, however, cannot seal as completely as the rest of the zipper, due to the small gaps inherent in the head and tail ends of a zipper closure. Thus, this junction where the zipper ends overlap is inherently more vulnerable to penetration by pests.

To remedy the vulnerability of the zipper closure and create a fully protected seam between the top and bottom portions of the mattress protector, a pest-impermeable system at the zipper junction is created by barrier 310, as best shown in FIG. 3B. Barrier 310 is configured to cover the tail portion 308 of the zipper. More specifically, barrier 310 is placed such that when the zipper is completely closed, barrier 310 fills the space between the zipper head 306 and the zipper tail 308. In one embodiment of the invention, barrier 310 is made of a somewhat deformable material that flexes when the zipper head 306 is moved into closing position over the zipper tail 308. For example, in one embodiment of the invention barrier 310 is configured of a neoprene material.

In operation, with reference here to FIGS. 1, 2, 3A and 3B, mattress protector 204 is fitted around mattress 200 as bottom portion 208 is placed around the bottom and lower part of the sides of the mattress. Top portion 206 is placed over the top portion of the mattress 202 and the top and bottom portions are fastened together with a fastener, such as, for example, a zipper. As the seam 116 is closed around the perimeter of the mattress, zipper head 306 is moved toward zipper tail 308. To securely fasten the zipper, and complete the impermeable enclosure of the mattress protector around the mattress, zipper head 306 is moved over barrier 310, which is placed over zipper tail portion 308. As zipper head 306 is pulled over zipper tail 308, barrier 310 deforms slightly to create a pest-impermeable barrier at the zipper junction. When the mattress top 206 becomes soiled or dirty, the mattress top 206 can be easily removed by unzipping the zipper at seam 116. The mattress top 206 can then be cleaned, while mattress bottom 208 can remain in place around the bottom of the mattress.

Not only do embodiments of the present invention provide for a pest-impermeable mattress protector, but the removable top design embodied in the present invention allows for the top of the mattress protector to be removed as needed, without requiring removal of the bottom portion of the mattress protector. Such a configuration increasing the ease with which the mattress protector can be cleaned. Installing the bottom portion of the mattress protector around the bottom of the mattress can be somewhat labor intensive, as it requires lifting the mattress to properly situate the mattress protector bottom around the bottom of the mattress. This procedure of lifting the mattress need only be performed once, when the mattress protector product is first installed, or put around the mattress. After the initial configuration of the mattress protector around the mattress, the bottom portion of the mattress protector can remain in place for the lifetime of the mattress protector, while the top portion of the mattress protector can be removed as needed for cleaning.

Finally, the configuration of the pest-impermeable barrier located at the ends of the fastener is shown in further detail in FIG. 4. Here, zipper end 402 is located above zipper end 404 when the zipper is moved into a closed position. Barrier 406, also referred to as a compressible member, is located between zipper end 402 and zipper end 404. Barrier 406 seals the junction of zipper ends 402 and 404, thus preventing bed bugs or dust mites from entering the mattress at this point.

In operation, a mattress protector is placed around a mattress when the bottom portion is situated around the bottom and lower side portions of the mattress. The top portion of the mattress protector is placed over the top of the mattress. The mattress protector is secured around a mattress as the top and bottom portions of the mattress protector are fastened together. In one embodiment of the invention, the area near the zipper that surround the perimeter of the mattress is reinforced with waterproof, pest-impermeable, breathable material to prevent penetration of the mattress protector at the convergence of the top and bottom portions of the mattress cover.

Moreover, further protection against pests infiltrating the mattress is provided at the junction of the zipper ends 402 and 404. Barrier 406 is connected to the mattress protector at this point to seal the junction of the zipper ends 402 and 404 and create a barrier impervious to pests. In one embodiment of the invention, barrier 406 is configured of a semi-deformable or compressible material that can flex to seal the space between the zipper ends 402 and 404. In one embodiment of the invention barrier 406 is configured of a neoprene material, such as, for example, a nylon encased neoprene.

In one embodiment of the invention, the closure assembly, which may include zipper ends 402 and 404, and barrier 406, in enclosed in fluid and pest impermeable fabric. The closure assembly is configured such that the zipper end 404 and barrier 406 are permanently located within the closure assembly. When the zipper is closed, or zipped, and the zipper end 402 is brought around to zipper end 404 and barrier 406, zipper end 402 also enters the closure assembly, where it is housed. The protection afforded the zipper junction by the closure assembly further ensures that pests cannot penetrate the end portions of a zipper or other fastener used to join the top and bottom portions of the mattress protector. In various embodiments, one or more of the above described features serve as unique obstructions to prevent bed bugs and dust mites from accessing a mattress. For example, the top and bottom of the mattress protector form a first obstruction to prevent bed bugs and dust mites from accessing a mattress. The seam forms a second obstruction to prevent bed bugs and dust mites from accessing a mattress. The first and second ends of the fastener further form a third obstruction to prevent bed bugs and dust mites from accessing a mattress when the first end of the fastener overlaps the second end of the fastener. The barrier of the fastener closure assembly forms a fourth obstruction to prevent bed bugs and dust mites from accessing a mattress. Combining one or more of these features results in an overall system to prevent bed bugs and dust mites from accessing a mattress.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

We claim:

1. A mattress protector, comprising:

a top portion having a top, two sides, and two ends configured to fit over a top, sides, and ends of a mattress;

a bottom portion having a bottom, two sides, and two ends configured to fit over the bottom, two sides, and two ends of a mattress or box spring;

a first side of a fastener connected to a bottom edge of the top portion;

a second side of the fastener connected to a top edge of the bottom portion;

the first and second sides of the fastener being configured to releasably interlock; said first and second sides further forming first and second ends of the fastener when releasably interlocked, wherein the first end of the fastener is capable of overlapping the second end of the fastener when the first and second sides of the fastener are releasably interlocked; and a fastener closure assembly having a barrier located in between the first and second ends of the fastener when the first and second sides of the fastener are releasably interlocked, such that when the first end of the fastener overlaps the second end of the fastener, the barrier seals the ends of the fastener to prevent bed bugs and dust mites from accessing a mattress.

2. The mattress protector as recited in claim 1, wherein the mattress protector is fabricated from liquid impermeable material.

3. The mattress protector as recited in claim 1, wherein the mattress protector is fabricated from material that is impervious to bed bugs and dust mites.

4. The mattress protector as recited in claim 1, wherein the bottom portion further includes an elastic piece integrated into the bottom.

5. The mattress protector as recited in claim 1, wherein the barrier is made of a neoprene material.

6. The mattress protector as recited in claim 1, wherein the closure assembly further includes an insert of at least one additional layer of fabric formed over and encasing the end point of the fastener creating a protected closure area impervious to bed bugs and dust mites.

7. The mattress protector as recited in claim 1, wherein one of the two ends of the top portion is sewn to one of the two ends of the bottom portion forming a closed end of the mattress protector.

8. The mattress protector as recited in claim 1, wherein the barrier is configured of a compressible material.

9. A mattress protector, comprising:

a top portion having a top, two sides, and two ends configured to fit over a top, sides, and ends of a mattress;

a bottom portion having a bottom, two sides, and two ends configured to fit over the bottom, two sides, and two ends of a mattress or box spring;

a first side of a fastener connected to a bottom edge of the top portion;

a second side of the fastener connected to a top edge of the bottom portion;

the first and second sides of the fastener each having a length greater than the circumference of a mattress and configured to releasably interlock; the first and second sides further forming first and second ends of the fastener when releasably interlocked, the first end of the fastener capable of overlapping the second end of the fastener when the first and second sides of the fastener are releasably interlocked;

a seam located adjacent to one or more sides of the fastener, the seam being configured of fluid and pest impermeable material, and further configured to overlap the first and second sides of the fastener when the first and second sides of the fastener are releasably interlocked; and a fastener closure assembly having a barrier located in between the first and second ends of the fastener when the first and second sides of the fastener are releasably interlocked, such that when the first end of the fastener overlaps the second end of the fastener, the barrier seals the ends of the fastener to prevent bed bugs and dust mites from accessing a mattress.

10. The mattress protector as recited in claim 9, wherein the closure assembly further includes an enclosure configured of fluid and pest impermeable fabric, wherein the closure assembly surrounds one or more end points of the fastener and the compressible member.

11. The mattress protector as recited in claim 9, wherein the closure assembly further includes an enclosure configured of fluid and pest impermeable fabric, wherein the closure assembly surrounds the one or more end points of the fastener and the compressible member.

12. The mattress protector as recited in claim 9, wherein the fastener is a zipper.

13. The mattress protector as recited in claim 9, wherein the top portion is completely removable from the bottom portion.

14. The mattress protector as recited in claim 9, wherein the top and bottom of the mattress protector form a first obstruction to prevent bed bugs and dust mites from accessing a mattress; and wherein the seam forms a second obstruction to prevent bed bugs and dust mites from accessing a mattress; and wherein the first and second ends of the fastener further form a third obstruction to prevent bed bugs and dust mites from accessing a mattress when the first end of the fastener overlaps the second end of the fastener; and wherein the barrier of the fastener closure assembly forms a fourth obstruction to prevent bed bugs an dust mites from accessing a mattress.

* * * * *